United States Patent [19]

Janes

[11] Patent Number: 5,060,944

[45] Date of Patent: Oct. 29, 1991

[54] TENNIS RACKET WITH SPLIT FRAME

[75] Inventor: Richard Janes, Belchertown, Mass.

[73] Assignee: Spalding & Evenflo Companies, Inc., Tampa, Fla.

[21] Appl. No.: 604,725

[22] Filed: Oct. 26, 1990

[51] Int. Cl.[5] ..... A63B 49/02; A63B 49/08

[52] U.S. Cl. ..... 273/73 R; 273/73 C; 273/73 G; 273/73 J

[58] Field of Search ..... 273/73 R, 73 C, 73 D, 273/73 E, 73 F, 73 G, 73 H, 73 K, 73 L

[56] References Cited

U.S. PATENT DOCUMENTS

| | | | |
|---|---|---|---|
| 3,664,668 | 5/1972 | Held | 273/73 D |
| 3,833,219 | 9/1974 | Dean | 273/73 J |
| 4,082,273 | 4/1978 | Ellzey | 273/73 J |
| 4,194,738 | 3/1980 | Inoue et al. | 273/73 C |
| 4,205,844 | 6/1980 | Gombas | 273/73 G |
| 4,220,335 | 9/1980 | Nobbs | 273/73 R |
| 4,394,014 | 7/1983 | Balaban | 273/73 G |

FOREIGN PATENT DOCUMENTS

| | | | |
|---|---|---|---|
| 0304324 | 2/1989 | European Pat. Off. | 273/73 J |

*Primary Examiner*—Edward M. Coven
*Assistant Examiner*—Raleigh W. Chiu

[57] ABSTRACT

A tennis racket comprising a frame formed of a pair of tubes attached together throughout the majority of the bow and then separated in the throat-beams for at least a portion of their extents; a yoke attached to the tubes adjacent to the ends of the throat-beams to form, in association with the portions of the tube, an essentially oval-shaped bow, the periphery of the bow having spaced holes therethrough; a single groove formed around the entire external periphery of the bow; a continuous grommet strip positioned within the groove and extending through the openings in the throat-beams and around the entire external periphery of the bow, the grommet strip being provided with spaced holes aligned with the holes of the bow; a bumper strip positioned under a portion of the grommet strip including the tip, the bumper strip being provided with spaced holes aligned with the holes of both the bow and the grommet strip, the holes of the bumper strip, grommet strip and bow being perpendicular to the tangent of the inner head arc and outer head arc of the frame; strings extending through the holes of the bumper strip, grommet strip and bow to form a planar ball-striking surface across the bow; a pallet surrounding the frame at the handle; and a grip surrounding the pallet at the handle for being grasped by a player.

22 Claims, 7 Drawing Sheets

Fig. 7
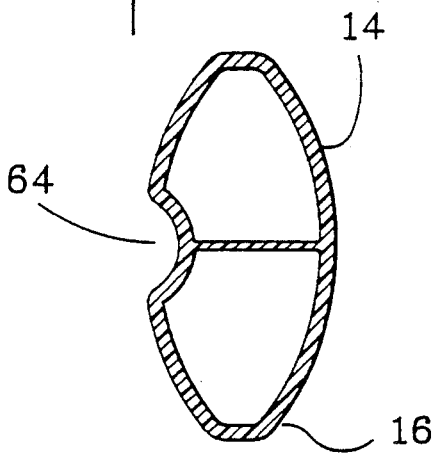
Fig. 8
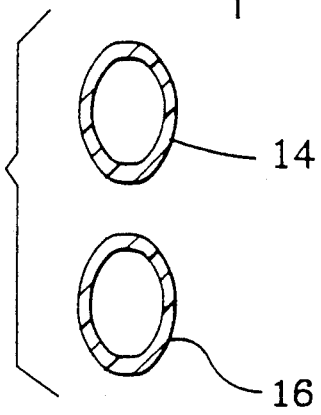
Fig. 16
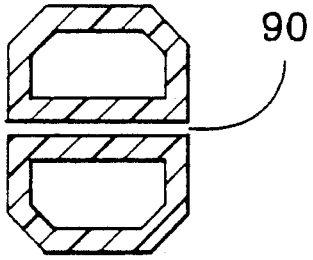
Fig. 17
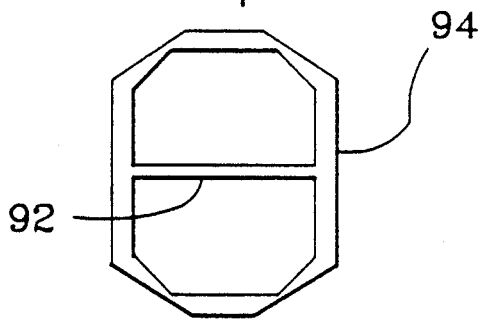
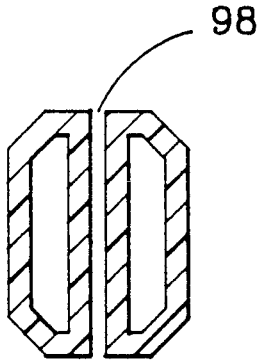
Fig. 18
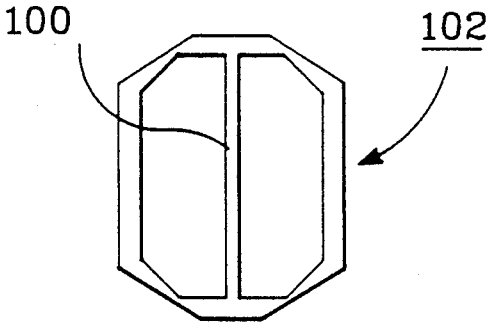
Fig. 19

TENNIS RACKET WITH SPLIT FRAME

BACKGROUND OF THE INVENTION

1. Field of the Invention

This invention relates to an improved tennis racket with a split frame and, more particularly, to a tennis racket frame formed of a pair of tubes attached together in the bow area and then separated in the throat-beams.

2. Summary of the Background Art

Modern tennis rackets are normally formed of a tube of moldable material. The tube is first bent internally concave in the plane of the strings into a shape with a bow extending from the tip at the top, then bent at an intermediate portion to extend to Y-shaped throat-beams, straight or curved, and then bent convexly extending in parallel handles to the but end at the bottom. A yoke piece is formed into the frame at the bow adjacent to the throat-beams. The yoke and bow portions of the frame form an oval with strings located thereacross to constitute a planar ball-striking surface.

Due to the construction of the frame, when a ball is struck by the strings of the racket, the strings and frame are bent rearwardly by the force of the ball. This causes those portions of the frame on the side remote from the ball to bend in a concave configuration generating compressive forces in the frame. At the same time, the portions of the frame on the same side as the ball generate tension forces in the frame. The combination of compression and tension forces on various portions of the frame will create a detrimental pattern of forces, including shear forces between the tension and compression forces, reducing the efficiency and life of the frame and racket.

In addition, there has been a recent effort to design tennis rackets with increased frequency. A typical design would enlarge the frame in a direction perpendicular to the strings at about the mid-point of the height of the racket between the tip and butt ends. When such frame construction is utilized, it is normally characterized by the stretching of the frame material during fabrication. When stretched, the walls of the frame become increasingly thinner and lighter weight. Strength is maintained by wrapping additional materials thereover during fabrication.

Lastly, the exterior periphery of the frame around the bow is normally provided with a grommet strip. Such grommet strip is actually a pair of strips, one over the upper portion of the bow extending symmetrically from the tip. The other grommet strip is on the exterior periphery of the yoke between the throat-beams. The construction of such conventional bows causes an inconvenience of installing grommet strips of plural parts for one function during construction and repair. Such grommet strip construction is discontinuous, separated at regions of the bow where it couples to the throat-beams whereat strings may not pass through the bow.

Various approaches are disclosed in the patent literature for improving tennis rackets, particularly tennis racket frames. Note, for example, U.S. Pat. Nos. 4,664,380 and 4,768,786 to Kuebler. Those patents teach enlarging the frame at about the mid-point of their height. Other portions of the frame remote from the handle may also be enlarged. Such enlargement is for increasing frame frequency. Using conventional fabrication techniques, the reduced thickness of the frame walls of such tennis rackets, unless bolstered by additional material provided during fabrication, will reduce strength. A similar design is commercially sold by the Wilson Corporation under the designation of PROFILE, a wide body tennis racket. The present invention attains increased stiffness through two separate beam tubes which are split at regions in the head resulting in reduced materials, weight and cost since there is no material between the tubes at the region of the split beams.

In addition, U.S. Pat. No. 1,539,019 to Nikonow teaches the use of thick frames. The Nikonow frame, however, is constructed of wood and does not address the fabrication problems of modern molded tennis rackets. In another patent, U.S. Pat. No. 4,913,434 to Fischer, a frame is made up of a pair of tubes. Such frame, however, separates the two tubes by an intermediate layer thereby complicating fabrication and incurring increased costs. Further, the tubes remain in such relationship throughout their entire extent and are not provided with openings in the throat-beams to facilitate the use of a one piece grommet strip. Lastly, U.S. Pat. No. 4,293,129 to Planakis discloses a tennis racket frame formed of two tubes. Such racket has two sets of strings, one on each tube in non-parallel planes.

As illustrated by the great number of prior patents and commercial devices and techniques, efforts are continuously being expended in an effort to improve tennis rackets and their frames. Such efforts are being made to render such frames more efficient, reliable, inexpensive and convenient to manufacture and use. None of these previous efforts, however, provides the benefits attendant with the present invention. Additionally, the prior patents and commercial devices and techniques do not suggest the present inventive combination of component elements arranged and configured as disclosed and claimed herein.

The present invention achieves its intended purposes, objects and advantages through an unobvious combination of component elements, with the use of a minimum number of parts, at a reasonable cost to manufacture and by employing only readily available materials.

Accordingly, it is an object of the present invention to provide an improved tennis racket comprising a frame formed of a pair of tubes extending from their mid points at the tip end in symmetric curves to form the majority of the string-supporting bow, then towards each other in an essentially V-shaped configuration to form the throat-beams, and then in a parallel configuration to form the handle and then terminating at the butt end, the tubes being attached together throughout the majority of the bow and then separated in the throat-beams for at least a portion of their extents; a yoke attached to the tubes adjacent to the ends of the throat-beams remote from the butt end to form, in association with the portions of the tubes between the throat-beams and the tip, an essentially oval-shaped bow, the periphery of the bow having spaced holes therethrough; a single groove formed around the entire external periphery of the bow; a continuous grommet strip positioned within the groove and extending through the openings in the throat-beams and around the entire external periphery of the bow, the grommet strip being provided with spaced holes aligned with the holes of the bow; a bumper strip positioned under a portion of the grommet strip including the tip, the bumper strip being provided with spaced holes aligned with the holes of both the bow and the grommet strip, the holes of the bumper strip, grommet strip and bow being perpendicular to the tangent of the inner head arc and outer head arc of the frame; strings extending through the holes of the bumper strip, grommet strip and bow to form a planar ball-striking surface across the bow; a pallet surrounding the frame at the handle; and a grip surrounding the pallet at the handle for being grasped by a player.

It is a further object of the present invention to separate the compression and tension forces, and to abate the stress forces therebetween which are normally imparted to a tennis racket frame upon the striking of balls.

It is a further object of the invention to configure two tubes into a tennis racket frame in a particular configuration so as to "engineer-in" the desired playing characteristics.

It is a further object of the present invention to form openings in the frame of a tennis racket in the throat-beam area.

It is a further object of the present invention to utilize a continuous grommet strip around the entire periphery of the frame.

It is a further object of the invention to form all the holes of the bumper strip, grommet strip and bow perpendicular to the tangent of the frame, at right angles to both the internal head arc and the external head arc.

The foregoing has outlined some of the more pertinent objects of the present invention. These objects should be construed to be merely illustrative of some of the more prominent features and applications of the intended invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

The present invention is defined by the appended claims. For the purposes of the present invention, the invention may be incorporated into an improved tennis racket comprising a frame formed of a pair of tubes extending from their mid points at the tip end in symmetric curves to form the majority of the string-supporting bow, then towards each other in an essentially V-shaped configuration to form the throat-beams, and then in a parallel configuration to form the handle and then terminating at the butt end, the tubes being attached together throughout the majority of the bow and then separated in the throat-beams for at least a portion of their extents; a yoke attached to the tubes adjacent to the ends of the throat-beams remote from the butt end to form, in association with the portions of the tubes between the throat-beams and the tip, an essentially oval-shaped bow, the periphery of the bow having spaced holes therethrough; a single groove formed around the entire external periphery of the bow; a continuous grommet strip positioned within the groove and extending through the openings in the throat-beams and around the entire external periphery of the bow, the grommet strip being provided with spaced holes aligned with the holes of the bow; a bumper strip positioned under a portion of the grommet strip including the tip, the bumper strip being provided with spaced holes aligned with the holes of both the bow and the grommet strip, the holes of the bumper strip, grommet strip and bow being perpendicular to the tangent of the inner head arc and outer head arc of the frame; strings extending through the holes of the bumper strip, grommet strip and bow to form a planar ball-striking surface across the bow; a pallet surrounding the frame at the handle; and a grip surrounding the pallet at the handle for being grasped by a player.

All the tubes may be attached to each other along their lengths in the handle. The tubes may all be separated from each other in the handles to form crossed spaces therebetween. Two of the tubes may be attached to each other along their lengths in the handle to form a planar space therebetween. The planar space may be parallel with the string plane or perpendicular with respect to the string plane. The tennis racket further includes a pallet with a cylindrical configuration between the tubes and grip in the handle. The cylindrical configuration need not be circular. The pallet may also include a cross-shaped portion separating the tubes from each other in the grip or a planar portion separating two tubes from the other two tubes in the grip, the planar portions being perpendicular with the strings or parallel with the string plane. The tubes have similar cross-section configurations each with a flat portion in contact with each other in the plane of the strings and include a concave portion which forms part of the groove. The opening in the throat-beams is of a distance substantially equal to the width of the grooves. The bumper strip is harder than the grommet strip.

The invention may also be incorporated into an improved game racket comprising a frame formed of a pair of tubes extending from their mid points to form the majority of the bow, then in an essentially V-shaped configuration to form the throat-beams, and then in a parallel configuration to form the handle, the tubes being attached together in the bow and then separated in the throat-beams; a yoke attached to the tubes adjacent to the ends of the throat-beams to form the bow; a groove formed around the entire external periphery of the bow; a grommet strip positioned within the groove and extending through the openings in the throat-beams; and strings extending through holes of the grommet strip and bow to form a planar ball-striking surface.

In addition, the invention may also be incorporated into an improved game racket comprising a frame formed of a pair of tubes extending from their mid points at the tip end in symmetric curves to form the majority of the string-supporting bow, then in an essentially V-shaped configuration to form the throat-beams, and then in a parallel configuration to form the handle and then terminating at the butt end, the tubes being attached together throughout the majority of the bow and then separated in the throat-beams for at least a portion of their extents; a yoke attached to the tubes adjacent to the ends of the throat-beams remote from the butt end to form, in association with the portions of the tubes between the throat-beams and the tip, an essentially oval-shaped bow, the periphery of the bow having spaced holes therethrough; and a single groove formed around the entire external periphery of the bow and extending through the openings in the throat-beams.

The invention may also be incorporated into an improved pallet for a game racket positionable over the frame of the racket at the handle end, the pallet having a cylindrical interior opening corresponding in size and shape to the cylindrical exterior surface of the frame, the pallet also having an internal planar portion bisecting the opening to separate the halves of the frame over and around which it is positioned. The internal planar portion may be parallel with the strings, perpendicular with respect to the string plane, or cross-shaped in configuration.

Lastly, the invention may be incorporated into a frame for a game racket comprising a frame formed of a pair of tubes extending from their mid points at the tip end in symmetric curves to form the majority of the string-supporting bow, then in an essentially V-shaped configuration to form the throat-beams, and then in a parallel configuration to form the handle and then terminating at the butt end, the tubes being attached together throughout the majority of the bow and then separated in the throat-beams for at least a portion of their extents; a yoke attached to the tubes adjacent to the ends of the throat-beams remote from the butt end to form, in association with the portions of the tubes between the throat-beams and the tip, an essentially oval-shaped bow, the periphery of the bow having spaced holes therethrough; and holes formed in the frame and yoke for the passage of strings, each of the holes being perpendicular to the tangent of the frame and yoke at the location of hole formation.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the disclosed specific embodiment may be readily utilized as a basis for modifying or designing other structures for carrying out the same purposes of the present invention. It should also be realized by those skilled in the art that such equivalent constructions do not depart from the spirit and scope of the invention as set forth in the appended claims.

DESCRIPTION OF THE DRAWINGS

For a full understanding of the nature and objects of the invention, reference should be had to the following detailed description taken in conjunction with the accompanying drawings in which:

FIG. 7 is a sectional view of the tubes in the bow taken along line 7—7 of FIG. 6.

FIG. 8 is a sectional view of the tubes in a throat-beam taken along line 8—8 of FIG. 6.

FIG. 13 is a sectional view of the frame taken along line 13—13 of FIG. 9 illustrating a first alternate embodiment of the invention.

FIG. 16 is a sectional view of the frame taken through the handle and illustrating a third alternate embodiment of the invention.

FIG. 18 is a sectional view of the frame taken through the handle and illustrating a fourth alternate embodiment of the invention.

FIG. 19 is a sectional view of a pallet positionable over the frame of the embodiment of FIG. 16.

Similar reference refer to similar parts throughout the several Figures.

DETAILED DESCRIPTION OF THE INVENTION

Figure 1:
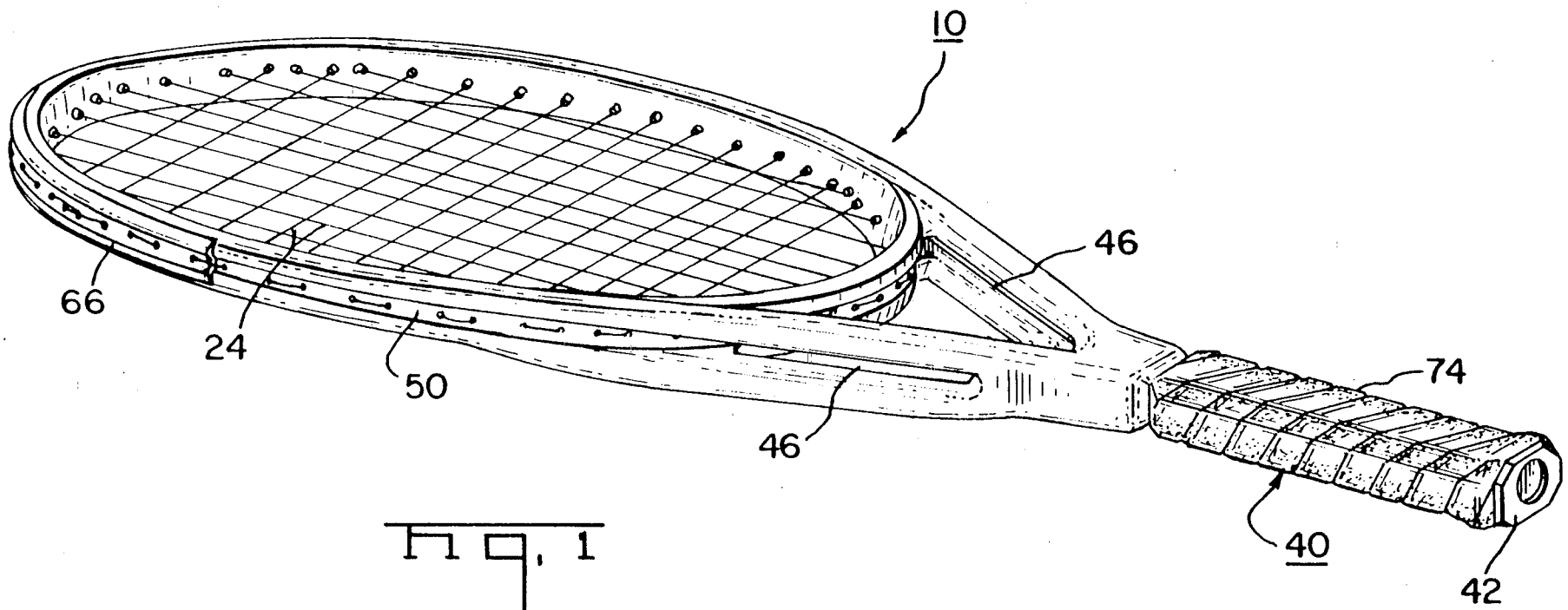
FIG. 1 is a perspective view of a tennis racket constructed in accordance with the principles of the present invention.
Figure 2:
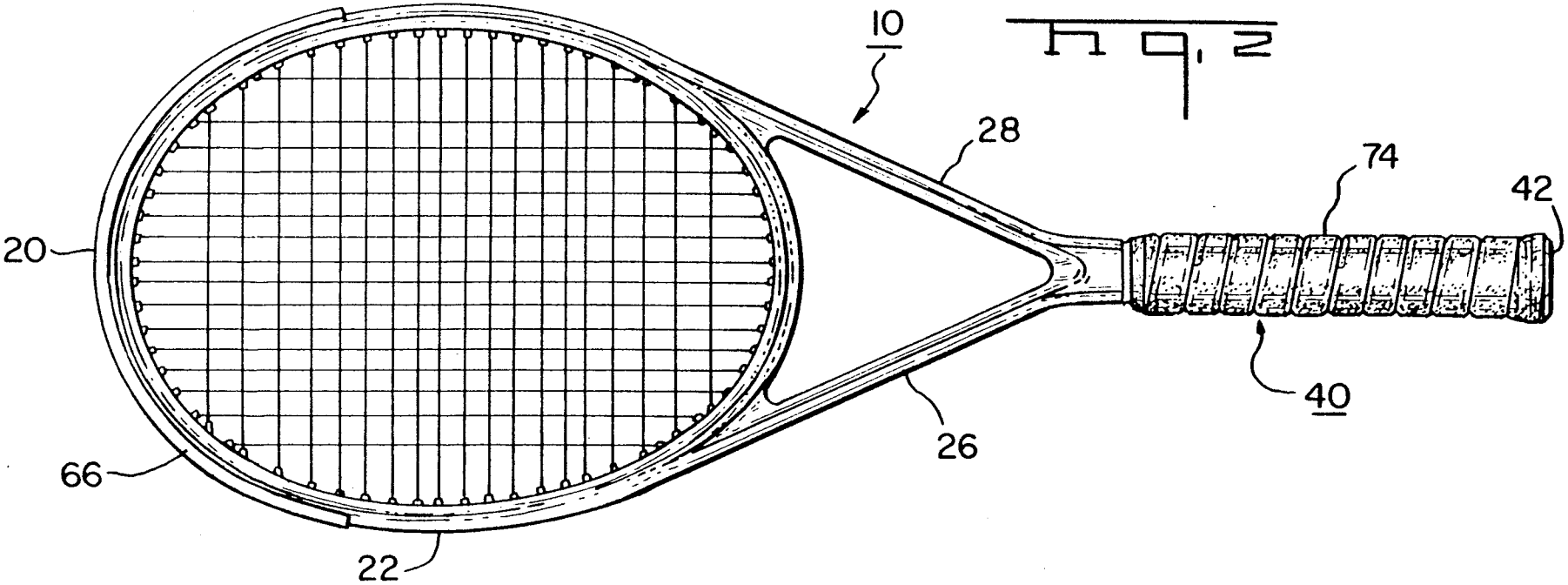
FIG. 2 is a front elevational view of the tennis racket shown in FIG. 1.
Figure 3:
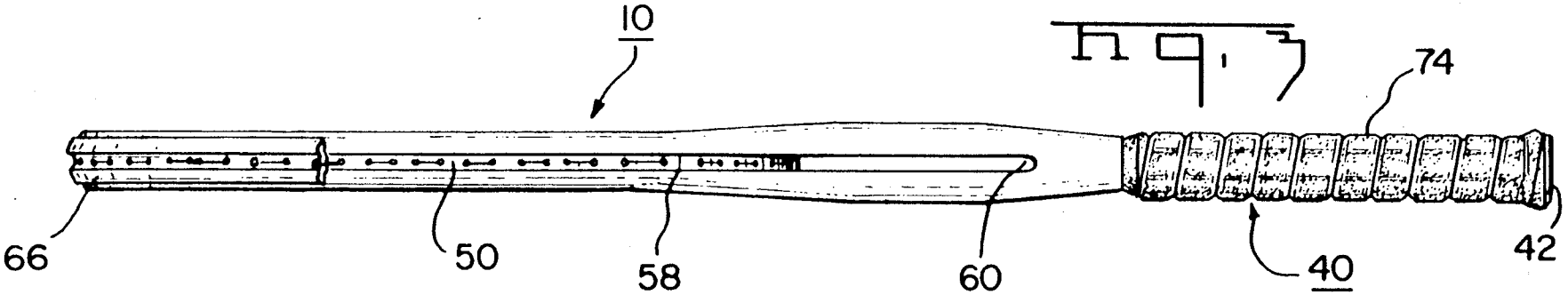
FIG. 3 is a side elevational view of the tennis racket shown in FIGS. 2 and 3.
Figure 4:
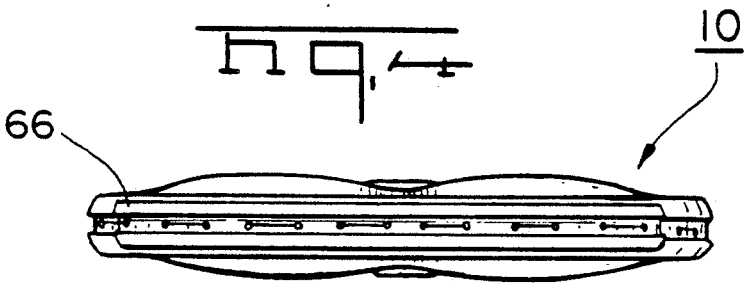
FIG. 4 is a top view of the tennis racket shown in FIGS. 2, 3 and 4.
Figure 5:
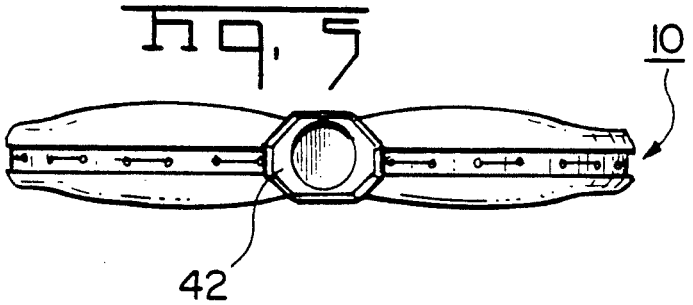
FIG. 5 is a bottom view of the tennis racket shown in FIGS. 2, 3 and 4.

With particular reference to the Figures, there is shown in FIGS. 1 through 5, a tennis racket 10 constructed in accordance with the principles of the present invention. The primary component of the tennis racket is its frame 12. The frame is fabricated from a pair of tubes 14 and 16. The cross-section of the tubes is shown in FIGS. 7 and 8. The tubes bend internally concavely in the plane of the strings from the mid-point 20 at the tip end of the racket and then in symmetric curves to form the majority of the bow 22. The bow is that portion of the racket adapted to support the ball-striking strings 24. The supported strings forms a tensioned string grid for striking the ball. The tubes then are configured to then curve in the plane of the strings toward each other into an essentially V-shaped configuration. At such locations the throat-beams 26 and 28 are formed. The throat-beams may be straight or curved. The throat-beams then curve convexly in the plane of the strings and are formed into a parallel configuration of beam portions 32, 34, 36 and 38 to form the handle 40. The bottom most end of the handle is the butt-end 42.

At the upper extent from the tip end and extending over the majority of the bow, the tubes are cohered together to form a unitary frame section. In the throat-beams, however, the tubes are separated to form separations or openings 46 on opposite sides of the racket. The separations in the preferred embodiment form the tube portions parallel with each other, parallel with and bisecting the plane of its strings. The width is such as to allow for the passage of a continuous grommet strip 50 therethrough. The grommet strip may be fabricated of one or a plurality of sections extending entirely around the external periphery of the bow. On opposite sides of the opening, the tubes are cohered to each other. By changing the size and/or shape of the openings in the frame, the playing characteristics of the frame and racket may be engineered-in, modified and designed for a particular preference.

At the lower most portion of the bow a yoke 54 is provided. The yoke is a piece of material, shown as curved, generally of the same construction as the remainder of the frame. The ends 56 of the yoke are attached as by cohesion to the bottom-most portion of the bow to complete the frame. For increased strength, the region of coupling between the yoke and bow are wrapped prior to being molded. Such wrapping is with a material such as graphite fibers which have been preimpregnated in an epoxy material or the like. The frame tubes as well as the tube to yoke coupling are connected by cohesion and wrapping materials, molded together. The two tubes are wrapped in the upper head area and where coupled to the yoke by wrapping material which includes uni-directional graphite fibers in an epoxy matrix with the fibers oriented at various angles. Other frame portions, such as the ends 58 and 60 of the openings, requiring increased strength are likewise wrapped. In this manner the yoke and the upper part of the frame together form an essentially oval-shaped opening for receipt of the ball striking strings.

Formed in the bow, the upper frame portion in combination with the yoke, is a groove 64. The groove is generally arcuate in cross-sectional configuration but may be formed with a flat bottom for receiving a correspondingly shaped grommet 50 and/or bumper strip 66. It is unitary and extends in a continuous manner entirely around the external periphery of the bow. Each tube has a concave portion which together, in association with a concave portion in the yoke, form the groove 64. Through the majority of the upper portion of the bow, centered at the tip and in the external portions of the yoke, the groove and grommet strip is essentially conventional. Because of the openings in the throat-beams, however, a single unitary groove and a continuous grommet strip may be utilized. In addition, over the top of the bow and under a portion of the grommet strip, there is a bumper guard or strip 66. The bumper guard is a strip of material extending in a direction perpendicular to the strings sufficient to cover the upper edges of the frame for protection against scraping of the frame during use. The center of the bumper strip is centered at the tip of the racket.

The bumper strip is preferably made of a relatively hard material to preclude abrasion or other damage to the frame during play. Conversely, the grommet strip is made of a relatively soft material to abate vibrations and minimize string damage and breakage. Details of such materials can be found in co-pending application Ser. No. 463,766; filed 1/12/90 in the name of R. Janes. The subject matter thereof is incorporated herein by reference.

Formed in the periphery of the frame around its entire extent are an array of holes 70 for the passage of strings 24 therethrough. In alignement with the holes of the frame are holes of the grommet strip. The holes of the grommet strip preferably extend through grommets formed as barrels 72, inwardly oriented members passing through the holes of the frame. In this manner, the strings may be threaded through the holes of the frame, grommet strips and grommet without touching the frame itself. Each hole and barrel extends through the frame perpendicularly, at right angles, to the tangent of the frame at the location of hole formation.

Contact between the strings is with the grommet material which is a softer material for preferred coupling between the strings and racket and for superior shot-making by the player. Similarly, holes in the bumper strip are aligned with the holes in grommet strip and frame with the strings extending therethrough to hold the bumper strip in proper orientation with respect to the grommet strip and frame.

The holes through the frame for the barrels and strings are drilled to extend through the common wall between the two cohered tubes. Because of the split frame construction, the holes are drilled, in the preferred mode, perpendicular to the tangent of the inner head arc as well as the outer head arc of the frame. Without such split frame construction, the more conventional holes adjacent to the 5 o'clock and 7 o'clock regions extend through the frame, head hoop and throat frame with excessively obtuse angles. Such prior art construction effects undesirable lower string tension, promotes breakage of the grommet strip and strings and results in inconsistent playability. Further, the split frame design of the present invention separates the concurrent tension and compression of the two tubes during shot-making thereby minimizing the undesirable sheer forces therebetween.

At the handle end of the racket is the grip 74. The grip is preferably formed as a spiral wound member, generally of leather or elastomer with similar characteristics, to insure preferred gripability of the racket by a player. The grip is generally of a softer material than the frame for comfort of the player.

Located between the soft grip and rigid frame is the pallet 76. The pallet is a cylindrical member of relatively rigid material. The pallet has an exterial surface of a shape, normally eight-sided, in cross-section, for being gripped by the player while retaining indexing capability. By that it is meant that by the feel of the grip with its octagonal shape of flat surfaces and edges, the player can properly position the racket and its strings with respect to the ball while making a shot. The interior surface of the pallet is formed of a size and shape to conform with the external surface of the tubes which form a grip.

In the preferred embodiment, the four ends 32, 34, 36 and 38 of the two tubes of the handle are attached together through cohesion during the molding process. The pallet can then be either molded in place onto the frame at the handle or it may be separately formed and slid thereon being secured in place as though an adhesive. Further, wrap material is employed around the joined two tubes for additional strength and to hold them together. Additional wrap material is also employed around each tube alone for further additional strength. The yoke piece is also additionally strengthened by wrap material for strength and bonding to the frame. The added wrapping material is preferrably provided during the layup where particular strength is needed as in the yoke, at its area of coupling to the frame and at the crotches of the separation between the beams.

Figure 6:
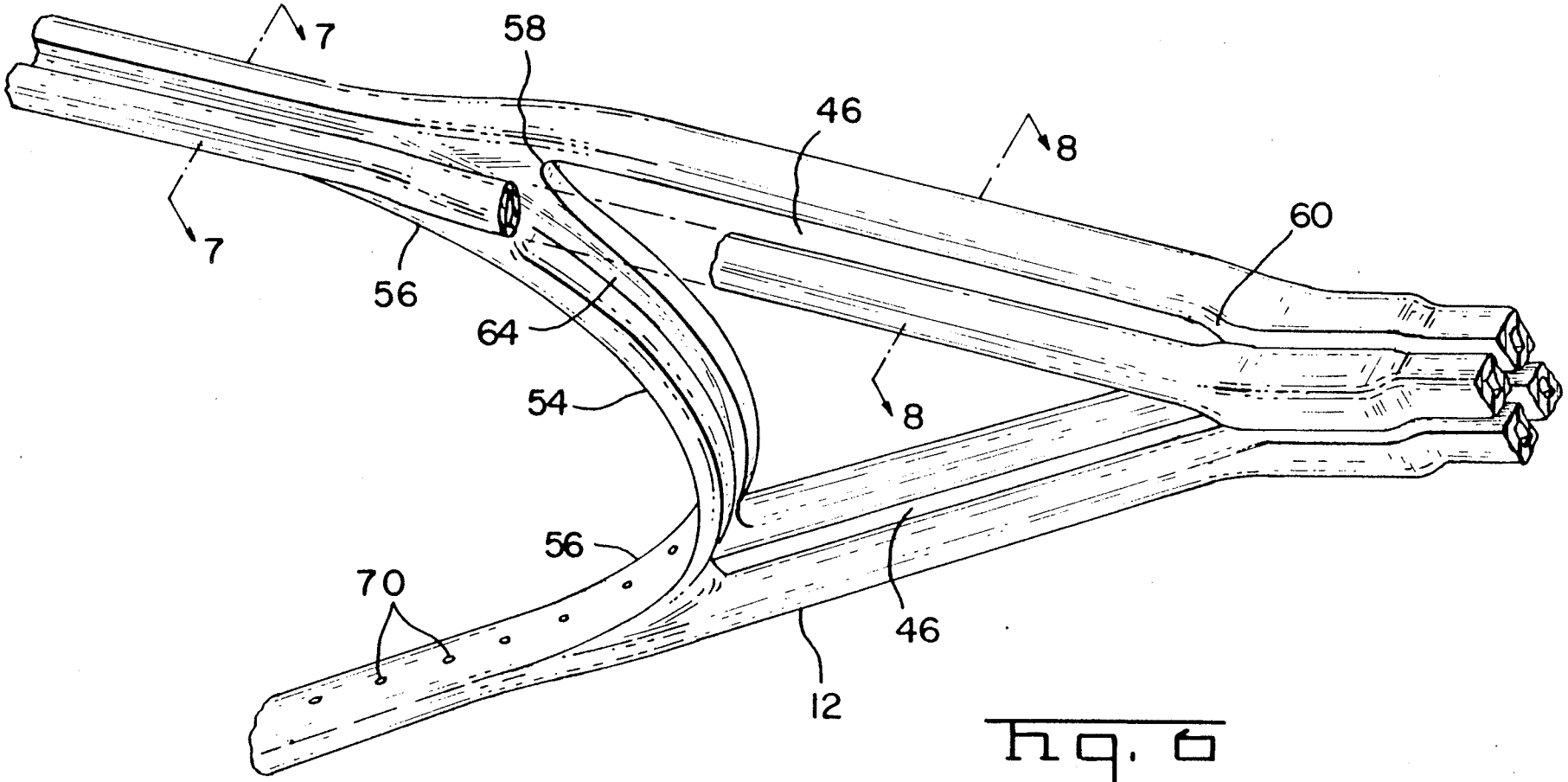
FIG. 6 is an enlarged fragmentary view of the throat-beam portions of a tennis racket similar to that shown in FIGS. 1 through 5 and also illustrating a portion of the handle and bow.
Figures 9, 14, 15, 17:
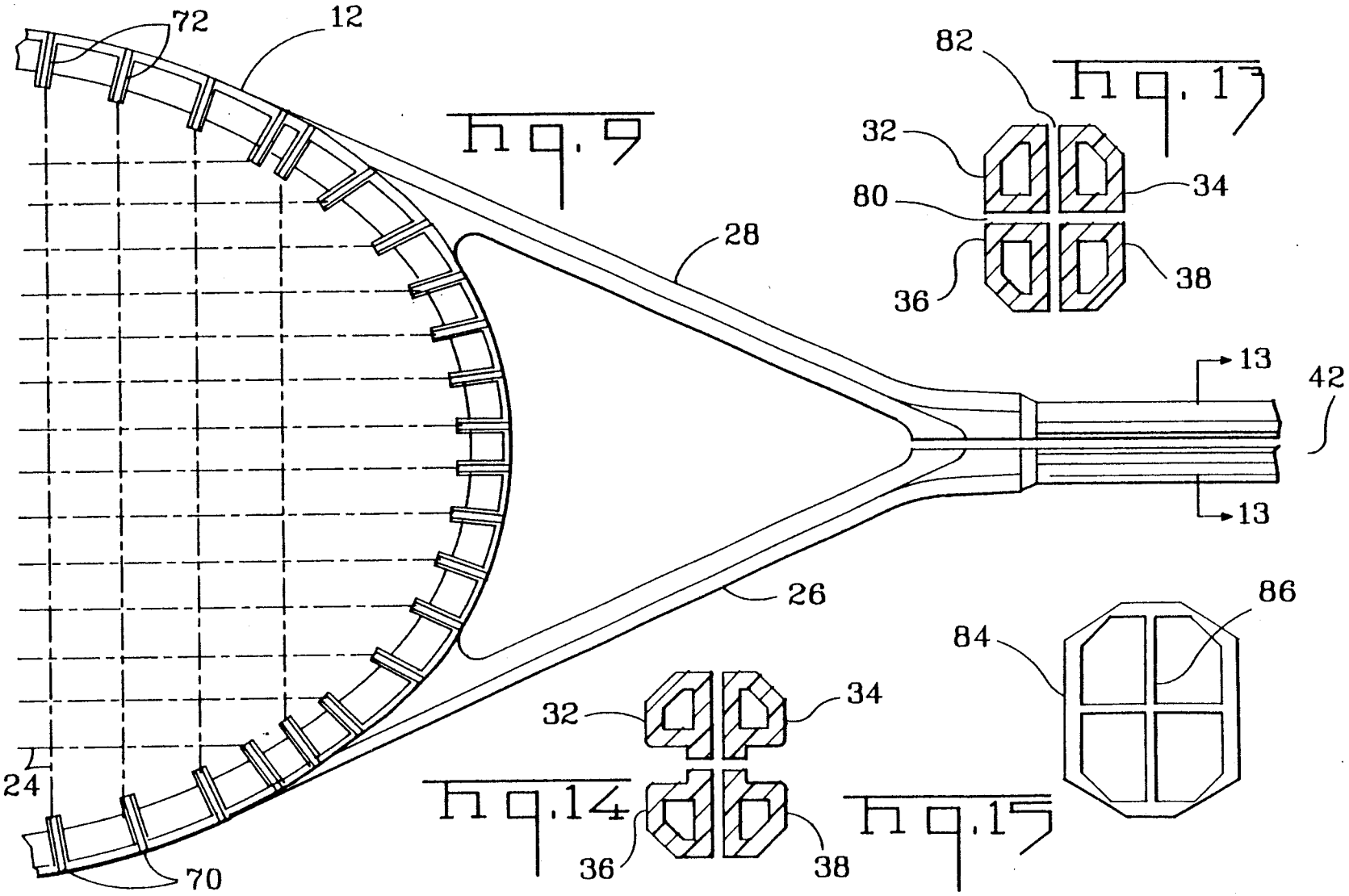
FIG. 9 is a sectional view taken along the central plane of portions of the tennis racket frame shown in the prior Figures.
FIG. 14 is a sectional view of the frame taken through the handle and illustrating a second alternate embodiment of the invention.
FIG. 15 is a sectional view of a pallet positionable over the frame of the embodiments of FIGS. 13 and 14.
FIG. 17 is a sectional view of a pallet positionable over the frame of the embodiment of FIG. 16.
Figure 11:
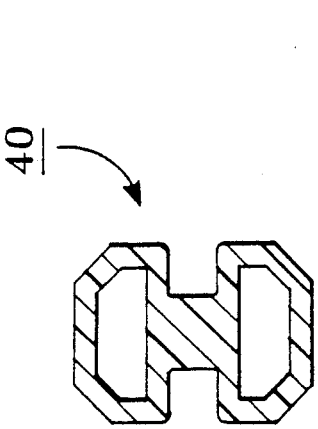
FIG. 11 is a sectional view of the frame taken along line 11—11 of FIG. 10.
Figure 12:
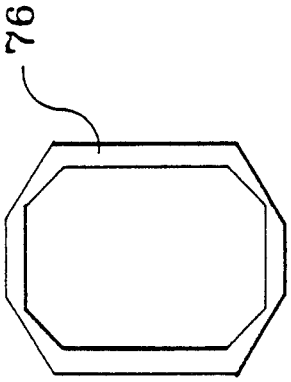
FIG. 12 is a sectional view of the pallet positionable over the frame at the handle end.
Figure 10:
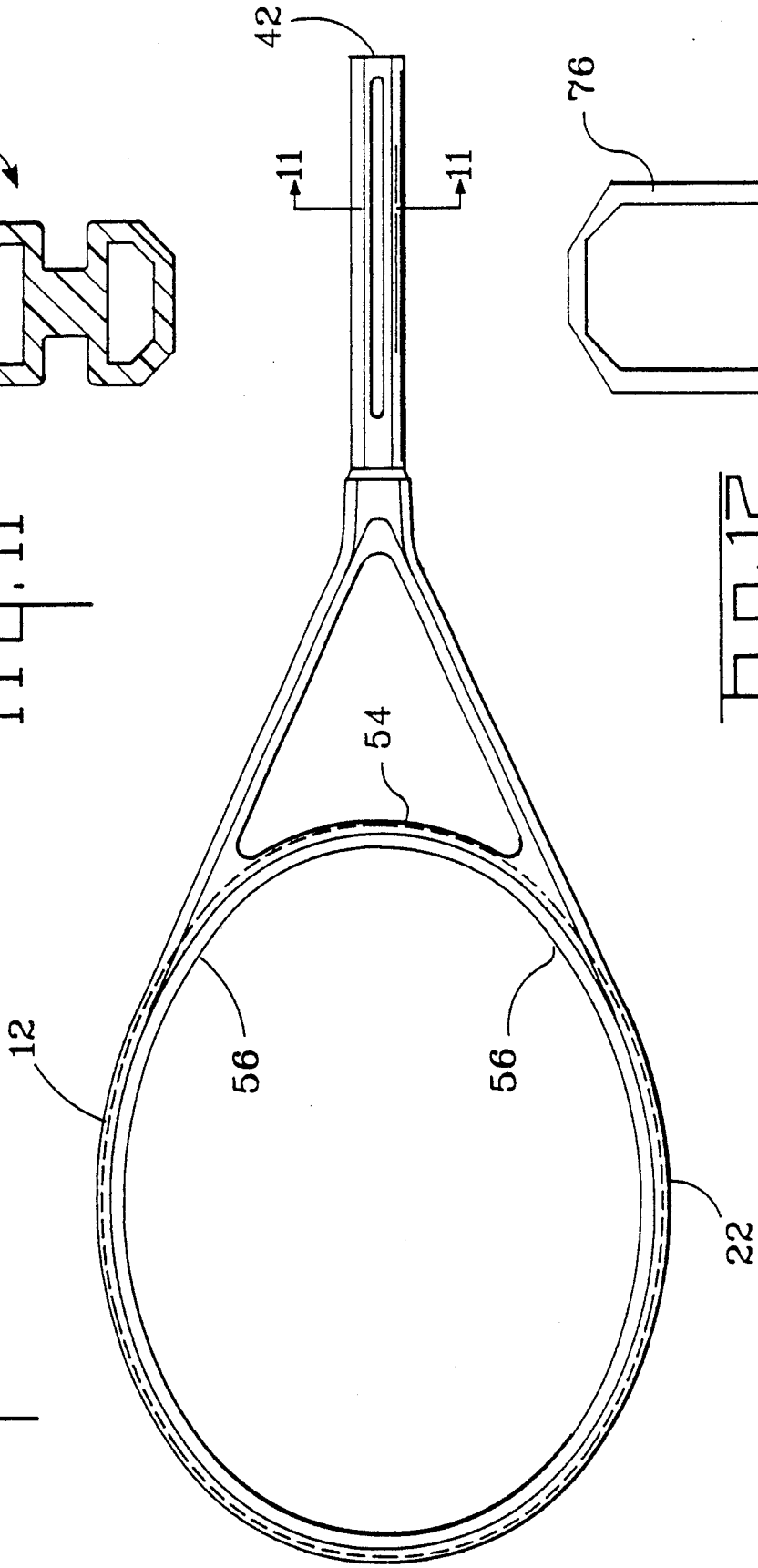
FIG. 10 is a front elevational view of the tennis racket similar to FIG. 2 but with the strings, pallet and grip removed.

In an alternate embodiment of the invention, the four tube ends of the frame may be molded to be separate and spaced from each other. Note FIGS. 6, 9, 13 and 14. When such configuration is utilized, two planar regions 80 and 82 are formed in the handle in a cross-like configuration. This would include one planar region 80 parallel with the strings. Symmetrically bisecting the region at a right angle is a second planar region 82. The pallet 84 for this handle is formed with an eight sided periphery similar to the pallet of the primary embodiment but includes, internally, a cross-shaped piece 86 of elastomer positionable in the two planar portions between the separated frame portions.

In the third and fourth embodiments of the invention, as illustrated in FIGS. 16,17 and 18,19, one of the two planes within the pallet are removed. In such embodiments, the tubes of the frame are only partially coupled. More specifically, the tube ends 32, 34 as well as 36, 38, parts on opposite sides of the plane of the strings are coupled but the others are not thereby creating a space 90 for the receipt of the planar piece 92 of the pallet 94 parallel to the plane of the strings. In the last embodiment of the invention, the tubes are attached perpendicular to the third embodiment for creation of a separation planar space 98 perpendicular to the plane of the strings. Space 90 is for the receipt of the planar piece 100 of the pallet 102. In all pallet and handle embodiments, the pallet has an exerior and interior configuration which corresponds in size and shape to the configuration of the tubes of the handle upon which the pallet is to be received. In all embodiments, the planes of elastomeric material between the tube sections in the handle functions to abate shocks and vibrations which result from the striking of tennis balls by the strings of the racket. Such materials also allow the throat shafts to spread the impact vibrations over a larger surface area and will abate shock from reaching the player's hand.

The preferred pallet material is a molded dense, soft urethane, cast from a mixture of isocyanate and polyol, having a durometer of about between 50 and 80 on the Shore A hardness scale. The urethane of the pallet, preferably, has a density of about between 8.0 and 10.0 pounds per cubic foot and is molded to include voids with entrapped gasses wherein such voids with entrapped gasses are more extensive adjacent to the frame at central regions of the pallet. Harder, more conventional materials could be also employed.

The fabrication of the frame in the present invention is a combination of conventional and new techniques. The two tubes are formed by hand lay-up followed by internal compression molding into a shape similar to those shapes shown in FIGS. 7 and 8. The FIG. 7 showing illustrates the two tubes after being cohered along the center of the horizontal straight line piece coupling the two curved sections. A conventional compression molding process is employed. An internal mandrel or core as of a thin plastic is positioned within each tube. The tubes are then bent into the intended final configuration with the tubes in contact with each other in those regions as intended for effecting the final design. In the throat-beam area of the tubes, the tubes are then separated to the desired size and shape. The configured tubes are then placed in a mold or press while the mandrel is filled with pressurized air for expanding and applying pressure to the interior of the tubes. A heated platen press encompasses the two-piece mold to insure that both proper pressure and heat are applied to the mold halves and tubes. Heating of the tubes by the mold through the mold is by conduction rather than convection, the heat being applied rapidly and evenly. When heat and pressure are applied to the tubes in this manner, the tubes will conform to the intended final shape, creating a frame and racket of superior construction by the curing of the epoxy material surrounding the graphite fibers.

The present invention allows for a greater racket stiffness with minimized weight and material costs. In effect, the split beam sections function as weighted end portions of an I-beam without a central web therebetween. As a result, there is no weight of material coupling such end portions. The present invention may be less expensive than frames of other fibers since less or cheaper materials are required for the same stiffness and playability.

The present disclosure includes that contained in the appended claims as well as that of the foregoing description. Although this invention has been described in its preferred forms with a certain degee of particularity, it is understood that the present disclosure of the preferred form has been made only by way of example and numerous changes in the details of construction and combination and arrangement of parts may be resorted to without departing from the spirit and scope of the invention.

Now that the invention has been described it is claimed:

1. A tennis racket comprising:

a frame formed of a pair of tubes extending from their mid points at the tip end in symmetric curves to form the majority of the string-supporting bow, then towards each other in an essentially V-shaped configuration to form the throat-beams, and then in a parallel configuration to form the handle and then terminating at the butt end, the tubes being attached together throughout the majority of the bow and then separated in the throat-beams for at least a portion of their extents;

a yoke attached to the tubes adjacent to the ends of the throat-beams remote from the butt end to form, in association with the portions of the tubes between the throat-beams and the tip, an essentially oval-shaped bow with an inner head arc and an outer head arc, the periphery of the bow having spaced holes therethrough;

a single groove formed around the entire external periphery of the bow;

a continuous grommet strip positioned within the groove and extending through the openings in the throat-beams and around the entire external periphery of the bow, the grommet strip being provided with spaced holes aligned with the holes of the bow;

a bumper strip positioned under a portion of the grommet strip including the tip, the bumper strip being provided with spaced holes aligned with the holes of both the bow and the grommet strip, the holes of the bumper strip, grommet strip and bow being perpendicular to the tangent of the inner head arc and outer head arc of the frame;

strings extending through the holes of the bumper strip, grommet strip and bow to form a planar ball-striking surface across the bow;

a pallet surrounding the frame at the handle; and a grip surrounding the pallet at the handle for being grasped by a player.

2. The tennis racket as set forth in claim 1 wherein all the tubes are attached to each other along their lengths in the handle.

3. The tennis racket as set forth in claim 1 wherein the tubes are all separated from each other in the handles to form crossed spaces therebetween.

4. The tennis racket as set forth in claim 1 wherein two of the tubes are attached to each other along their lengths in the handle to form a planar space therebetween.

5. The tennis racket as set forth in claim 4 wherein the planar space is parallel with the string plane.

6. The tennis racket as set forth in claim 4 wherein the planar space is perpendicular with respect to the string plane.

7. The tennis racket as set forth in claim 1 and further including a pallet with a cylindrical configuration between the tubes and grip in the handle.

8. The tennis racket as set forth in claim 7 wherein the pallet also includes a cross-shaped portion separating the tubes from each other in the grip.

9. The tennis racket as set forth in claim 7 wherein the pallet also includes a planar portion separating tube portions from other tube portions in the grip.

10. The tennis racket as set forth in claim 9 wherein the planar portions are perpendicular with the string plane.

11. The tennis racket as set forth in claim 9 wherein the planar portion is parallel with the string plane.

12. The tennis racket as set forth in claim 1 wherein the tubes have similar cross-section configurations each with a flat portion in contact with each other in the plane of the strings.

13. The tennis racket as set forth in claim 12 wherein each of the tubes includes a concave portion which form part of the groove.

14. The tennis racket as set forth in claim 13 wherein the opening in the throat-beams is of a width substantially equal to the width of the grooves.

15. The tennis racket as set forth in claim 1 wherein the bumper strip is harder than the grommet strip.

16. A game racket comprising:

a frame formed of a pair of similarly shaped tubes extending from their mid points to form the majority of the bow, then in an essentially V-shaped configuration to form the throat-beams, and then in a parallel configuration to form the handle, the tubes being attached together in the bow and then separated in the throat-beams;

a yoke attached to the tubes adjacent to the ends of the throat-beams to form the bow;

a single groove formed around the entire external periphery of the bow;

a grommet strip positioned within the groove and extending through the openings in the throat-beams; and strings extending through holes of the grommet strip and bow to form a planar ball-striking surface.

17. A frame for a game racket comprising:

a frame formed of a pair of similarly shaped tubes extending from their mid points at the tip end in symmetric curves to form the majority of the string-supporting bow, then in an essentially V-shaped configuration to form the throat-beams, and then in a parallel configuration to form the handle and then terminating at the butt end, the tubes being attached together throughout the majority of the bow and then separated in the throat-beams for at least a portion of their extents;

a yoke attached to the tubes adjacent to the ends of the throat-beams remote from the butt end to form, in association with the portions of the tubes between the throat-beams and the tip, an essentially oval-shaped bow, the periphery of the bow having spaced holes therethrough; and a single groove formed around the entire external periphery of the bow and extending through the openings in the throat-beams.

18. A frame for a game racket comprising:

a frame formed of a pair of similarly shaped tubes extending from their mid points at the tip end in symmetric curves to form the majority of the string-supporting bow, then in an essentially V-shaped configuration to form the throat-beams, and then in a parallel configuration to form the handle and then terminating at the butt end, the tubes being attached together throughout the majority of the bow and then separated in the throat-beams for at least a portion of their extents;

a yoke attached to the tubes adjacent to the ends of the throat-beams remote from the butt end to form, in association with the portions of the tubes between the throat-beams and the tip, an essentially oval-shaped bow, the periphery of the bow having spaced holes therethrough; and holes formed in the frame and yoke for the passage of strings, each of the holes being perpendicular to the tangent of the frame and yoke at the location of hole formation.

19. A unitive pallet for a game racket positionable over the frame of the racket at the handle end, the pallet having a cylindrical interior opening corresponding in size and shape to the cylindrical exterior surface of the frame, the pallet also having an internal planar portion bisecting the opening to separate the halves of the frame over and around which it is positioned.

20. The pallet as set forth in claim 18 wherein the internal planar portion is parallel with the string plane.

21. The pallet as set forth in claim 18 wherein the internal planar portion is perpendicular with respect to the string plane.

22. The pallet as set forth in claim 18 wherein the internal planar portion is cross-shaped in configuration.

* * * * *